US010323880B2

(12) United States Patent
Roberts et al.

(10) Patent No.: US 10,323,880 B2
(45) Date of Patent: Jun. 18, 2019

(54) MIXED REFRIGERANT COOLING PROCESS AND SYSTEM

(71) Applicant: Air Products and Chemicals, Inc., Allentown, PA (US)

(72) Inventors: Mark Julian Roberts, Kempton, PA (US); Gowri Krishnamurthy, Sellersville, PA (US); Adam Adrian Brostow, Emmaus, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 310 days.

(21) Appl. No.: 15/277,539

(22) Filed: Sep. 27, 2016

(65) Prior Publication Data

US 2018/0087832 A1 Mar. 29, 2018

(51) Int. Cl.
*F25J 1/02* (2006.01)
*F25J 1/00* (2006.01)

(52) U.S. Cl.
CPC ..... *F25J 1/0214* (2013.01); *F25J 1/0022* (2013.01); *F25J 1/0052* (2013.01); *F25J 1/0055* (2013.01); *F25J 1/0262* (2013.01); *F25J 1/0265* (2013.01); *F25J 1/0292* (2013.01); *F25J 2205/02* (2013.01); *F25J 2205/90* (2013.01); *F25J 2210/60* (2013.01); *F25J 2230/60* (2013.01); *F25J 2240/40* (2013.01); *F25J 2245/02* (2013.01); *F25J 2270/66* (2013.01)

(58) Field of Classification Search
CPC ..... F25J 1/0214; F25J 1/0215; F25J 1/0217; F25J 2270/12
See application file for complete search history.

(56) References Cited

U.S. PATENT DOCUMENTS 4,112,700 A * 9/1978 Forg ..... F25J 1/0022 62/612
4,339,253 A * 7/1982 Caetani ..... F25J 1/0022 62/612
4,755,200 A * 7/1988 Liu ..... B01D 53/265 62/612

(Continued)

FOREIGN PATENT DOCUMENTS

DE 102004032710 A1 9/2006
JP 2009543894 A 12/2009

(Continued)

*Primary Examiner* — Tareq Alosh
(74) *Attorney, Agent, or Firm* — Amy Carr-Trexler

(57) ABSTRACT

The present invention relates to methods of increasing the operability, capacity, and efficiency of natural gas liquefaction processes, with a focus on mixed refrigerant cycles. The present invention also relates to natural gas liquefaction systems in which the above-mentioned methods can be carried out. More specifically, a refrigerant used in a pre-cooling heat exchanger of a natural gas liquefaction plant is withdrawn from the pre-cooling heat exchanger, separated into liquid and vapor streams in a liquid-vapor separator after being cooled and compressed. The vapor portion is further compressed, cooled, and fully condensed, then returned to the liquid-vapor separator. Optionally, the fully condensed stream may be circulated through a heat exchanger before being returned to the liquid-vapor separator for the purpose of cooling other streams, including the liquid stream from the liquid-vapor separator.

12 Claims, 7 Drawing Sheets

(56) References Cited

U.S. PATENT DOCUMENTS

| | | | | |
|---|---|---|---|---|
| 5,535,594 | A | 7/1996 | Grenier | |
| 5,657,643 | A | 8/1997 | Price et al. | |
| 5,865,041 | A | 2/1999 | Agrawal et al. | |
| 5,943,881 | A * | 8/1999 | Grenier | F25J 1/0022 62/612 |
| 6,269,655 | B1 | 8/2001 | Roberts et al. | |
| 6,334,334 | B1 | 1/2002 | Stockmann et al. | |
| 6,347,532 | B1 * | 2/2002 | Agrawal | F25J 1/0214 62/612 |

FOREIGN PATENT DOCUMENTS

| | | |
|---|---|---|
| KR | 20010040029 A | 5/2001 |
| WO | 2010112206 | 10/2010 |
| WO | 2011136544 | 11/2011 |

* cited by examiner

MIXED REFRIGERANT COOLING PROCESS AND SYSTEM

BACKGROUND

A number of liquefaction systems for cooling, liquefying, and optionally sub-cooling natural gas are well known in the art, such as the single mixed refrigerant (SMR) cycle, the propane-precooled mixed refrigerant (C3MR) cycle, the dual mixed refrigerant (DMR) cycle, C3MR-Nitrogen hybrid (such as AP-X™) cycles, the nitrogen or methane expander cycle, and cascade cycles. Typically, in such systems, natural gas is cooled, liquefied, and optionally sub-cooled by indirect heat exchange with one or more refrigerants. A variety of refrigerants might be employed, such as mixed refrigerants, pure components, two-phase refrigerants, gas phase refrigerants, etc. Mixed refrigerants (MR), which are a mixture of nitrogen, methane, ethane/ethylene, propane, butanes, and pentanes, have been used in many base-load liquefied natural gas (LNG) plants. The composition of the MR stream is typically optimized based on the feed gas composition and operating conditions.

The refrigerant is circulated in a refrigerant circuit that includes one or more heat exchangers and a refrigerant compression system. The refrigerant circuit may be closed-loop or open-loop. Natural gas is cooled, liquefied, and/or sub-cooled by indirect heat exchange in one or more refrigerant circuits by indirect heat exchanger with the refrigerants in the heat exchangers.

The refrigerant compression system includes a compression sequence for compressing and cooling the circulating refrigerant, and a driver assembly to provide the power needed to drive the compressors. The refrigerant compression system is a critical component of the liquefaction system because the refrigerant needs to be compressed to high pressure and cooled prior to expansion in order to produce a cold low pressure refrigerant stream that provides the heat duty necessary to cool, liquefy, and optionally sub-cool the natural gas.

Referring to FIG. 1, a typical DMR process of the prior art is shown in liquefaction system 100. A feed stream, which is preferably natural gas, is cleaned and dried by known methods in a pre-treatment section (not shown) to remove water, acid gases such as $CO_2$ and $H_2S$, and other contaminants such as mercury, resulting in a pre-treated feed stream 101. The pre-treated feed stream 101, which is essentially water free, is precooled in a precooling system 134 to produce precooled natural gas stream 102 and further cooled, liquefied, and/or sub-cooled in a main cryogenic heat exchanger (MCHE) 165 to produce LNG stream 104. The LNG stream 104 is typically let down in pressure by passing it through a valve or a turbine (not shown) and is then sent to LNG storage tank (not shown). Any flash vapor produced during the pressure letdown and/or boil-off in the tank may be used as fuel in the plant, recycled to feed, and/or sent to flare.

The pre-treated feed stream 101 is precooled to a temperature below 10 degrees Celsius, preferably below about 0 degrees Celsius, and more preferably below about −30 degrees Celsius. The precooled natural gas stream 102 is liquefied by cooling to a temperature between about −150 degrees Celsius and about −70 degrees Celsius, preferably between about −145 degrees Celsius and about −100 degrees Celsius, and subsequently sub-cooled to a temperature between about −170 degrees Celsius and about −120 degrees Celsius, preferably between about −170 degrees Celsius and about −140 degrees Celsius. MCHE 165 shown in FIG. 1 is a coil wound heat exchanger with two tube bundles, a warm bundle 166 and a cold bundle 167. However, any number of bundles and any exchanger type may be utilized.

The term "essentially water free" means that any residual water in the pre-treated feed stream 101 is present at a sufficiently low concentration to prevent operational issues associated with water freeze-out in the downstream cooling and liquefaction process. In the embodiments described herein, water concentration is preferably not more than 1.0 ppm and, more preferably between 0.1 ppm and 0.5 ppm.

The precooling refrigerant used in the DMR process is a mixed refrigerant (MR) referred to herein as warm mixed refrigerant (WMR), comprising components such as nitrogen, methane, ethane/ethylene, propane, butanes, and other hydrocarbon components. As illustrated in FIG. 1, a warm low pressure WMR stream 110 is withdrawn from the bottom of the shell side of precooling heat exchanger 160 and is compressed and cooled in WMR compression system 111 to produce compressed WMR stream 132. The WMR compression system 111 is described in FIG. 2. The compressed WMR stream 132 is cooled in a tube circuit of precooling heat exchanger 160 to produce a cold stream, which is then let down in pressure across first WMR expansion device 137 to produce expanded WMR stream 135. The expanded WMR stream 135 is injected into the shell-side of precooling heat exchanger 160 and warmed against the pre-treated feed stream 101 to produce the warm low pressure WMR stream 110. FIG. 1 shows a coil wound heat exchanger with a single tube bundle for the precooling heat exchanger 160, however any number of tube bundles and any type of heat exchanger may be employed.

In the DMR process, liquefaction and sub-cooling is performed by heat exchanging precooled natural gas against a second mixed refrigerant stream, referred to herein as cold mixed refrigerant (CMR).

A warm low pressure CMR stream 140 is withdrawn from the bottom of the shell side of the MCHE 165, sent through a suction drum (not shown) to separate out any liquids and the vapor stream is compressed in CMR compressor 141 to produce compressed CMR stream 142. The warm low pressure CMR stream 140 is typically withdrawn at a temperature at or near WMR precooling temperature and preferably less than about −30 degree Celsius and at a pressure of less than 10 bara (145 psia). The compressed CMR stream 142 is cooled in a CMR aftercooler 143 to produce a compressed cooled CMR stream 144. Additional phase separators, compressors, and aftercoolers may be present. The process of compressing and cooling the CMR after it is withdrawn from the bottom of the MCHE 165 is generally referred to herein as the CMR compression sequence.

The compressed cooled CMR stream 144 is then cooled against evaporating WMR in precooling system 134 to produce a precooled CMR stream 145, which may be fully condensed or two-phase depending on the precooling temperature and composition of the CMR stream. FIG. 1 shows an arrangement where the precooled CMR stream 145 is two-phase and is sent to a CMR phase separator 164 from which a CMR liquid (CMRL) stream 147 and a CMR vapor (CMRV) stream 146 are obtained, which are sent back to MCHE 165 to be further cooled. Liquid streams leaving phase separators are referred to in the industry as MRL and vapor streams leaving phase separators are referred to in the industry as MRV, even after they are subsequently liquefied.

Both the CMRL stream 147 and CMRV stream 146 are cooled, in two separate circuits of the MCHE 165. The CMRL stream 147 is cooled and partially liquefied in the warm bundle of the MCHE 165, resulting in a cold stream that is let down in pressure across CMRL expansion device 149 to produce an expanded CMRL stream 148, that is sent back to the shell-side of MCHE 165 to provide refrigeration required in the warm bundle 166. The CMRV stream 146 is cooled in the first and second tube bundles of MCHE 165, and reduced in pressure across the CMRV expansion device 151 to produce expanded CMRV stream 150 that is introduced to the MCHE 165 to provide refrigeration required in the cold bundle 167 and warm bundle 166.

MCHE 165 and precooling heat exchanger 160 can be any exchanger suitable for natural gas cooling and liquefaction such as a coil wound heat exchanger, plate and fin heat exchanger or a shell and tube heat exchanger. Coil wound heat exchangers are the state of art exchangers for natural gas liquefaction and include at least one tube bundle comprising a plurality of spiral wound tubes for flowing process and warm refrigerant streams and a shell space for flowing a cold refrigerant stream.

FIG. 2 shows the details of the WMR compression system 211. Any liquid present in warm low pressure WMR stream 210 is removed by passing through a phase separator (not shown) and the vapor stream from the phase separator is compressed in low pressure WMR compressor 212 to produce medium pressure WMR stream 213 that is cooled in low pressure WMR aftercooler 214 to produce cooled medium pressure WMR stream 215. The low pressure WMR aftercooler 214 may further comprise multiple heat exchangers such as a desuperheater and a condenser. The cooled medium pressure WMR stream 215 may be two-phase and sent to WMR phase separator 216 to produce a WMR vapor (WMRV) stream 217 and WMR liquid (WMRL) stream 218. The WMRV stream 217 is compressed in high pressure WMR compressor 221 to produce high pressure WMR stream 222 and cooled in high pressure WMR desuperheater 223 to produce desuperheated high pressure WMR stream 224. The WMRL stream 218 is pumped to produce pumped WMRL stream 220 at a pressure comparable to that of the desuperheated high pressure WMR stream 224. The pumped WMRL stream 220 and the desuperheated high pressure WMR stream 224 are mixed to produce mixed high pressure WMR stream 225 that is cooled in high pressure WMR condenser 226 to produce compressed WMR stream 232. The mixed high pressure WMR stream 225 is two-phase with a vapor fraction of about 0.5.

The high pressure WMR condenser 226 may be a plate and fin heat exchanger or brazed aluminum heat exchanger and must be designed to handle two-phase inlet flow. One of the challenges in doing so is that the liquid and vapor phases will distribute unevenly in the high pressure WMR condenser 226. As a result, the compressed WMR stream 232 will likely not be fully condensed, which will in turn imply reduced process efficiency for the precooling and liquefaction processes. Additionally, the two entry heat exchanger may involve operational challenges.

One approach to address these problems is to compensate for the mal-distribution of liquid and vapor in the design of high pressure WMR condenser 226 and design it to be significantly larger than in the case without mal-distribution, such that the compressed WMR stream 232 is fully condensed. However, there are two drawbacks associated with this method. First, since the degree of mal-distribution in the condenser is unpredictable, this method is somewhat arbitrary and may result in non-zero vapor fraction in compressed WMR stream 232. Second, this method results in increased capital cost and plot space, which is undesirable.

Another solution to address the problem is to cool the WMRL stream 218 and the compressed WMR stream 232 in separate tube circuits of the precooling heat exchanger 260 to about the same precooling temperature. Each cooled stream would be letdown in pressure across separate expansion devices (similar to the first WMR expansion device 237) and sent as shellside refrigerant into the precooling heat exchanger 260. Alternatively, both cooled streams could be combined and letdown in pressure in a common expansion device. This approach eliminates the issue of two-phase entry in the high pressure WMR condenser 226, however it reduces the overall efficiency of the liquefaction process, in some cases up to 4% lower efficiency as compared to FIG. 2. Further, this solution would imply an additional tube circuit in the coil wound heat exchanger or additional passages in a plate and fin heat exchanger which imply increased capital cost.

Another solution involves fully condensing the desuperheated high pressure WMR stream 224 prior to mixing with the pumped WMRL stream 220. This method further involves cooling the mixed streams in a tube circuit of the precooling heat exchanger 260. However, this method has the same drawbacks as described for the previous solution with separate tube circuits.

A further solution involves dividing the precooling heat exchanger 260 into two sections, a warm section and a cold section. In case of a coil wound heat exchanger, the warm and cold sections may be separate tube bundles within the precooling heat exchanger 260. The WMRL stream 218 is cooled in a separate tube circuit in the warm section of precooling heat exchanger 260, reduced in pressure across an expansion device, and returned as shell side refrigerant to provide refrigeration to the warm section. The compressed WMR stream 232 is cooled in a separate tube circuit in the warm and cold sections of the precooling heat exchanger 260, reduced in pressure across an expansion device, and returned as shell side refrigerant to provide refrigeration to the cold and warm sections. This arrangement eliminates the issues of two phase entry and also improve the overall efficiency of the liquefaction process as compared to FIG. 2. However, they result in significant increase in capital cost due to breaking up the precooling heat exchanger into multiple sections, and is often not desirable.

A reliable and efficient solution is desired that eliminates two-phase entry in the condenser, at the same time does not increase the capital cost of the facility significantly. This invention provides novel WMR configurations that eliminate two-phase inlet into the high pressure WMR condenser 226 as well as eliminates the WMR pump 268, thereby reducing capital cost and improving operability and design of the DMR process. The inventions may also be applied to any cooling, liquefaction or subcooling processes involving multiple component refrigerants.

SUMMARY

Aspect 1: A method of cooling a hydrocarbon feed stream by indirect heat exchange with a first refrigerant stream in a cooling heat exchanger wherein the method comprises:

a) compressing a warm low pressure first refrigerant stream in one or more compression stages to produce a compressed first refrigerant stream;

b) cooling the compressed first refrigerant stream in one or more cooling units to produce a compressed cooled first refrigerant stream;

c) introducing the compressed cooled first refrigerant stream into a first vapor-liquid separation device to produce a first vapor refrigerant stream and a first liquid refrigerant stream;

d) introducing the first liquid refrigerant stream into the cooling heat exchanger;

e) cooling the first liquid refrigerant stream in the cooling heat exchanger to produce a cooled liquid refrigerant stream;

f) expanding the cooled liquid refrigerant stream to produce a cold refrigerant stream, introducing the cold refrigerant stream into the cooling heat exchanger to provide refrigeration duty required to cool the hydrocarbon feed stream, the first liquid refrigerant stream, and a second refrigerant stream;

g) compressing the first vapor refrigerant stream in one or more compression stages to produce a compressed vapor refrigerant stream;

h) cooling and condensing the compressed vapor refrigerant stream to produce a condensed refrigerant stream;

i) expanding the condensed refrigerant stream to produce an expanded refrigerant stream;

j) introducing the expanded refrigerant stream into the first vapor-liquid separation device;

k) introducing the second refrigerant stream into the cooling heat exchanger;

l) introducing the hydrocarbon feed stream in the cooling heat exchanger; and m) cooling the hydrocarbon feed stream in the cooling heat exchanger to produce a cooled hydrocarbon stream; and further cooling and liquefying the cooled hydrocarbon stream in a main heat exchanger to produce a liquefied hydrocarbon stream.

Aspect 2: The method of Aspect 1, wherein step (i) comprises introducing the expanded refrigerant stream into the first vapor-liquid separation device by mixing the expanded refrigerant stream with the compressed cooled first refrigerant stream upstream of the first vapor-liquid separation device.

Aspect 3: The method of any of Aspects 1-2, wherein the only first refrigerant stream to be cooled in the cooling heat exchanger is the first liquid refrigerant stream.

Aspect 4: The method of any of Aspects 1-3, wherein:

step (e) further comprises cooling the first liquid refrigerant stream in the cooling heat exchanger by passing the first refrigerant stream through a first tube circuit of the cooling heat exchanger, wherein the cooling heat exchanger is a coil wound heat exchanger;

step (m) further comprises cooling the hydrocarbon feed stream in the cooling heat exchanger by passing the hydrocarbon feed stream through a second tube circuit of the cooling heat exchanger; and step (f) further comprises introducing the cold refrigerant stream into a shell-side of the cooling heat exchanger.

Aspect 5: The method of any of Aspects 1-4, further comprising:

n) cooling the second refrigerant stream in the cooling heat exchanger to produce a cooled second refrigerant stream;

o) further cooling the cooled second refrigerant stream in the main heat exchanger to produce a further cooled second refrigerant stream;

p) expanding the further cooled second refrigerant stream to produce an expanded second refrigerant stream;

q) returning the expanded second refrigerant stream to the main heat exchanger; and r) further cooling and condensing the cooled hydrocarbon stream by indirect heat exchange with the expanded second refrigerant stream in the main heat exchanger to produce the liquefied hydrocarbon stream.

Aspect 6: The method of any of Aspects 1-5, further comprising, prior to performing step (d), cooling at least a portion of the first liquid refrigerant stream by indirect heat exchange with at least a portion of the expanded refrigerant stream in a first heat exchanger.

Aspect 7: The method of Aspect 6, further comprising cooling at least a portion of the hydrocarbon feed stream in the first heat exchanger prior to performing step (l).

Aspect 8: The method of any of Aspects 6-7, further comprising cooling at least a portion of the second refrigerant stream in the first heat exchanger prior to performing step (k).

Aspect 9: The method of any of Aspects 1-8, further comprising:

k) introducing the expanded refrigerant stream into a second vapor-liquid separation device to produce a second vapor refrigerant stream and a second liquid refrigerant stream;

l) introducing the second vapor refrigerant stream into the first vapor-liquid separation device;

m) cooling the first liquid refrigerant stream by indirect heat exchange with the second liquid refrigerant stream in a first heat exchanger prior to cooling the first liquid refrigerant stream in the cooling heat exchanger in step (d); and n) after performing step (m), introducing the second liquid refrigerant stream into the first vapor-liquid separation device.

Aspect 10: The method of Aspect 9, wherein the second vapor refrigerant stream and the second liquid refrigerant stream are mixed with the compressed cooled first refrigerant stream of step (b) upstream of the first vapor-liquid separation device prior to the introduction of the second vapor refrigerant stream and the second liquid refrigerant stream into the first vapor-liquid separation device.

Aspect 11: The method of any of Aspects 1-10, wherein step (c) comprises introducing the compressed cooled first refrigerant stream into a first vapor-liquid separation device comprising a mixing column to produce a first vapor refrigerant stream and a first liquid refrigerant stream.

Aspect 12: The method of Aspect 11, wherein the compressed cooled first refrigerant stream is introduced into the mixing column at or above a top stage of the mixing column and the expanded first refrigerant stream is introduced to the mixing column at or below a bottom stage of the mixing column.

Aspect 13: The method of any of Aspects 1-12, wherein the hydrocarbon feed stream is natural gas.

Aspect 14: The method of any of Aspects 1-12, wherein the condensed refrigerant stream is fully condensed.

Aspect 15: The method of any of Aspects 1-14, wherein steps a) and c) further comprise:

a) compressing a warm low pressure first refrigerant stream in one or more compression stages to produce a compressed first refrigerant stream, wherein the warm low pressure first refrigerant stream has a first composition;

c) introducing the compressed cooled first refrigerant stream into a first vapor-liquid separation device to produce a first vapor refrigerant stream and a first liquid refrigerant stream, wherein the first vapor refrigerant stream has a second composition, the second composition having a higher percentage (on a molar basis) of components lighter than ethane than the first composition.

Aspect 16: The method of any of Aspects 1-15, wherein step a) further comprises:

a) compressing a warm low pressure first refrigerant stream in one or more compression stages to produce a compressed first refrigerant stream, wherein the warm low pressure first refrigerant stream has a first composition consisting of less than 10% components lighter than ethane.

Aspect 17: The method of any of Aspects 1-16, wherein step c) further comprises:

c) introducing the compressed cooled first refrigerant stream into a first vapor-liquid separation device to produce a first vapor refrigerant stream and a first liquid refrigerant stream, wherein the first vapor refrigerant stream has a second composition consisting of less than 20% components lighter than ethane.

Aspect 18: An apparatus for cooling a hydrocarbon feed stream comprising:

a cooling heat exchanger including a first hydrocarbon feed circuit, a first refrigerant circuit, a second refrigerant circuit, a first refrigerant circuit inlet located at an upstream end of the first refrigerant circuit, a first pressure letdown device located at a downstream end of the first refrigerant circuit, and an expanded first refrigerant conduit downstream from and in fluid flow communication with the pressure letdown device, the cooling heat exchanger being operationally configured to cool, by indirect heat exchange against a cold refrigerant stream, the hydrocarbon feed stream as it flows through the first hydrocarbon feed circuit, thereby producing a pre-cooled hydrocarbon feed stream, a first refrigerant flowing through the first refrigerant circuit, and a second refrigerant flowing through the second refrigerant circuit; and a compression system comprising:

a warm low pressure first refrigerant conduit in fluid flow communication with a lower end of the cooling heat exchanger and a first compressor;

a first aftercooler in fluid flow communication with and downstream from the first compressor;

a first vapor-liquid separation device having a first inlet in fluid flow communication with and downstream from the first aftercooler, a first vapor outlet located in an upper half of the first vapor-liquid separation device, a first liquid outlet located in a lower half of the first vapor-liquid separation device, the first liquid outlet being upstream from and in fluid flow communication with the first refrigerant circuit inlet;

a second compressor downstream from and in fluid flow communication with the first vapor outlet;

a condenser downstream from and in fluid flow communication with the second compressor; and a second pressure letdown device downstream from and in fluid flow communication with the condenser, the second pressure letdown device being upstream from and in fluid flow communication with the first vapor-liquid separation device, so that all fluid that flows through the second pressure letdown device flows through the first vapor-liquid separation device before flowing to the cooling heat exchanger.

Aspect 19: The apparatus of Aspect 18, further comprising:

a main heat exchanger having a second hydrocarbon circuit that is downstream from and in fluid flow communication with the first hydrocarbon circuit of the cooling heat exchanger, the main heat exchanger being operationally configured to at least partially liquefy the pre-cooled hydrocarbon feed stream by indirect heat exchange against the second refrigerant.

Aspect 20: The apparatus of any of Aspects 18-19, further comprising:

a first heat exchanger having a first heat exchange circuit that is operationally configured to provide indirect heat exchange against a second heat exchange circuit, the first heat exchange circuit being downstream from and in fluid flow communication with the second pressure letdown device and the second heat exchange circuit being downstream from and in fluid flow communication with the first liquid outlet of the first liquid-vapor separation device.

Aspect 21: The apparatus of any of Aspects 18-20, further comprising:

a second vapor-liquid separation device having a third inlet in fluid flow communication with and downstream from the second pressure letdown device, a second vapor outlet located in an upper half of the second vapor-liquid separation device, a second liquid outlet located in a lower half of the second vapor-liquid separation device, the first liquid outlet being upstream from and in fluid flow communication with the first heat exchange circuit of the first heat exchanger.

Aspect 22: The apparatus of any of Aspects 18-21, wherein the first heat exchanger further comprises a third heat exchange circuit and a fourth heat exchange circuit, the third heat exchange circuit being upstream from and in fluid flow communication with the first refrigerant circuit, the fourth heat exchange circuit being upstream from and in fluid flow communication with the first hydrocarbon feed circuit, the first heat exchanger being operationally configured to cool fluids flowing through the second heat exchange circuit, third heat exchange circuit, and fourth heat exchange circuit against the first heat exchange circuit.

Aspect 23: The apparatus of any of Aspects 18-22, wherein the first vapor-liquid separation device is a mixing column.

Aspect 24: The apparatus of Aspect 23, wherein the first inlet of the first liquid-vapor separation device is located at a top stage of the mixing column and the second inlet of the first liquid-vapor separation device is located at a bottom stage of the mixing column.

Aspect 25: The apparatus of any of Aspects 18-24, wherein the cooling heat exchanger is a coil-wound heat exchanger.

Aspect 26: The apparatus of any of Aspects 18-25, further comprising a desuperheater downstream from and in fluid flow communication with the second compressor and upstream from and in fluid flow communication with the condenser.

Aspect 27: The apparatus of any of Aspects 18-26, wherein the first refrigerant consists of a first mixed refrigerant.

Aspect 28: The apparatus of any of Aspects 18-27, wherein the second refrigerant consists of a second refrigerant having a different composition than the first mixed refrigerant.

DETAILED DESCRIPTION OF INVENTION

Figure 1:
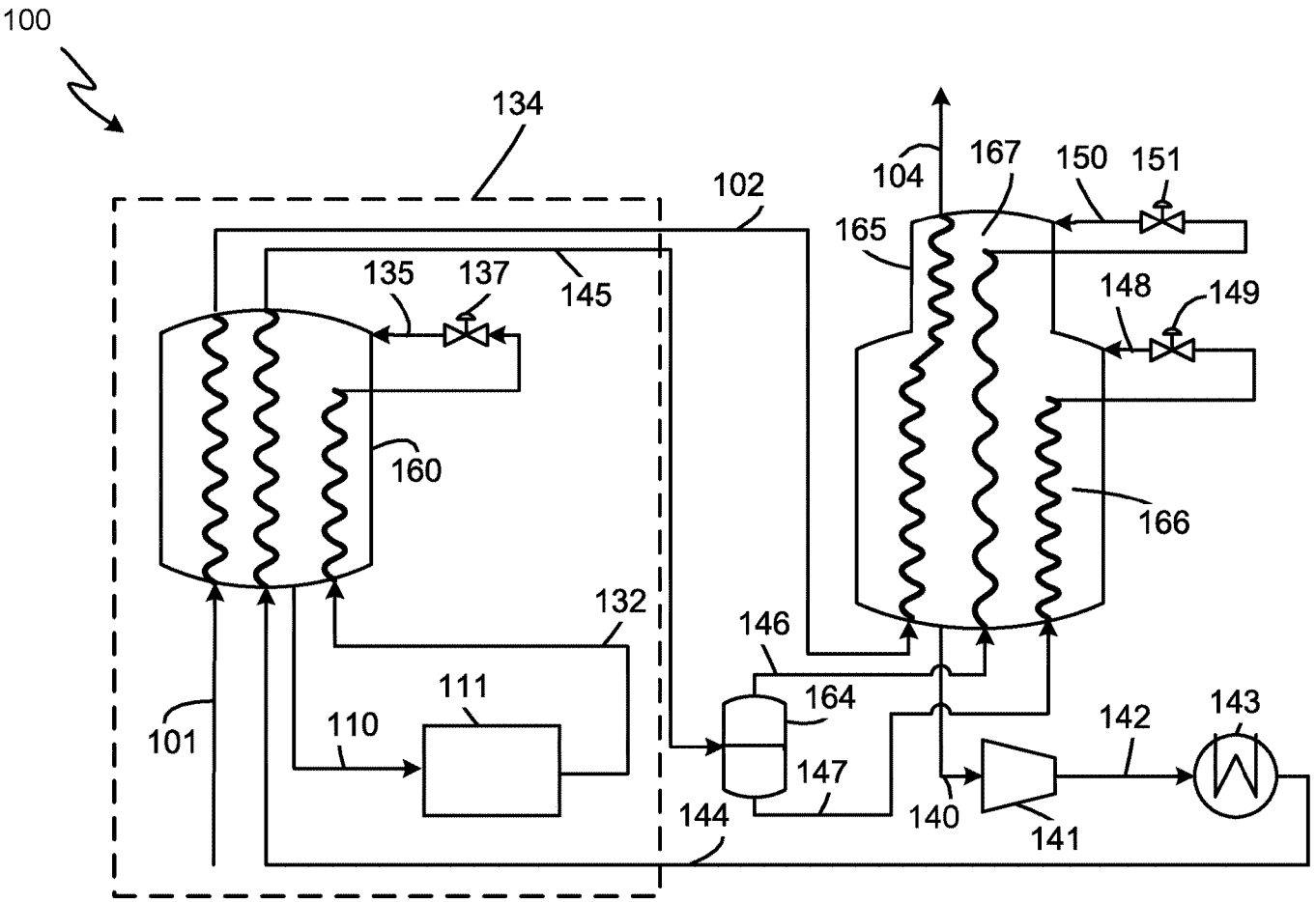
FIG. 1 (PRIOR ART)
FIG. 1 is a schematic flow diagram of a DMR system in accordance with the prior art.

The ensuing detailed description provides preferred exemplary embodiments only, and is not intended to limit the scope, applicability, or configuration of the claimed invention. Rather, the ensuing detailed description of the preferred exemplary embodiments will provide those skilled in the art with an enabling description for implementing the preferred exemplary embodiments of the claimed invention. Various changes may be made in the function and arrangement of elements without departing from the spirit and scope of the claimed invention.

Reference numerals that are introduced in the specification in association with a drawing figure may be repeated in one or more subsequent figures without additional description in the specification in order to provide context for other features.

The term "fluid flow communication," as used in the specification and claims, refers to the nature of connectivity between two or more components that enables liquids, vapors, and/or two-phase mixtures to be transported between the components in a controlled fashion (i.e., without leakage) either directly or indirectly. Coupling two or more components such that they are in fluid flow communication with each other can involve any suitable method known in the art, such as with the use of welds, flanged conduits, gaskets, and bolts. Two or more components may also be coupled together via other components of the system that may separate them, for example, valves, gates, or other devices that may selectively restrict or direct fluid flow.

The term "conduit," as used in the specification and claims, refers to one or more structures through which fluids can be transported between two or more components of a system. For example, conduits can include pipes, ducts, passageways, and combinations thereof that transport liquids, vapors, and/or gases.

The term "natural gas", as used in the specification and claims, means a hydrocarbon gas mixture consisting primarily of methane.

The terms "hydrocarbon gas" or "hydrocarbon fluid", as used in the specification and claims, means a gas/fluid comprising at least one hydrocarbon and for which hydrocarbons comprise at least 80%, and more preferably at least 90% of the overall composition of the gas/fluid.

The term "mixed refrigerant" (abbreviated as "MR"), as used in the specification and claims, means a fluid comprising at least two hydrocarbons and for which hydrocarbons comprise at least 80% of the overall composition of the refrigerant.

The term "heavy mixed refrigerant", as used in the specification and claims, means an MR in which hydrocarbons at least as heavy as ethane comprise at least 80% of the overall composition of the MR. Preferably, hydrocarbons at least as heavy as butane comprise at least 10% of the overall composition of the mixed refrigerant.

The terms "bundle" and "tube bundle" are used interchangeably within this application and are intended to be synonymous.

The term "ambient fluid", as used in the specification and claims, means a fluid that is provided to the system at or near ambient pressure and temperature.

In the claims, letters are used to identify claimed steps (e.g. (a), (b), and (c)). These letters are used to aid in referring to the method steps and are not intended to indicate the order in which claimed steps are performed, unless and only to the extent that such order is specifically recited in the claims.

Directional terms may be used in the specification and claims to describe portions of the present invention (e.g., upper, lower, left, right, etc.). These directional terms are merely intended to assist in describing exemplary embodiments, and are not intended to limit the scope of the claimed invention. As used herein, the term "upstream" is intended to mean in a direction that is opposite the direction of flow of a fluid in a conduit from a point of reference during normal operation of the system being described. Similarly, the term "downstream" is intended to mean in a direction that is the same as the direction of flow of a fluid in a conduit from a point of reference during normal operation of the system being described.

As used in the specification and claims, the terms "high-high", "high", "medium", and "low" are intended to express relative values for a property of the elements with which these terms are used. For example, a high-high pressure stream is intended to indicate a stream having a higher pressure than the corresponding high pressure stream or medium pressure stream or low pressure stream described or claimed in this application. Similarly, a high pressure stream is intended to indicate a stream having a higher pressure than the corresponding medium pressure stream or low pressure stream described in the specification or claims, but lower than the corresponding high-high pressure stream described or claimed in this application. Similarly, a medium pressure stream is intended to indicate a stream having a higher pressure than the corresponding low pressure stream described in the specification or claims, but lower than the corresponding high pressure stream described or claimed in this application.

Unless otherwise stated herein, any and all percentages identified in the specification, drawings and claims should be understood to be on a weight percentage basis. Unless otherwise stated herein, any and all pressures identified in the specification, drawings and claims should be understood to mean gauge pressure.

As used herein, the term "cryogen" or "cryogenic fluid" is intended to mean a liquid, gas, or mixed phase fluid having a temperature less than −70 degrees Celsius. Examples of cryogens include liquid nitrogen (LIN), liquefied natural gas (LNG), liquid helium, liquid carbon dioxide and pressurized, mixed phase cryogens (e.g., a mixture of LIN and gaseous nitrogen). As used herein, the term "cryogenic temperature" is intended to mean a temperature below −70 degrees Celsius.

Unless otherwise stated herein, introducing a stream at a location is intended to mean introducing substantially all of the said stream at the location. All streams discussed in the specification and shown in the drawings (typically represented by a line with an arrow showing the overall direction of fluid flow during normal operation) should be understood to be contained within a corresponding conduit. Each conduit should be understood to have at least one inlet and at least one outlet. Further, each piece of equipment should be understood to have at least one inlet and at least one outlet.

Figure 3:
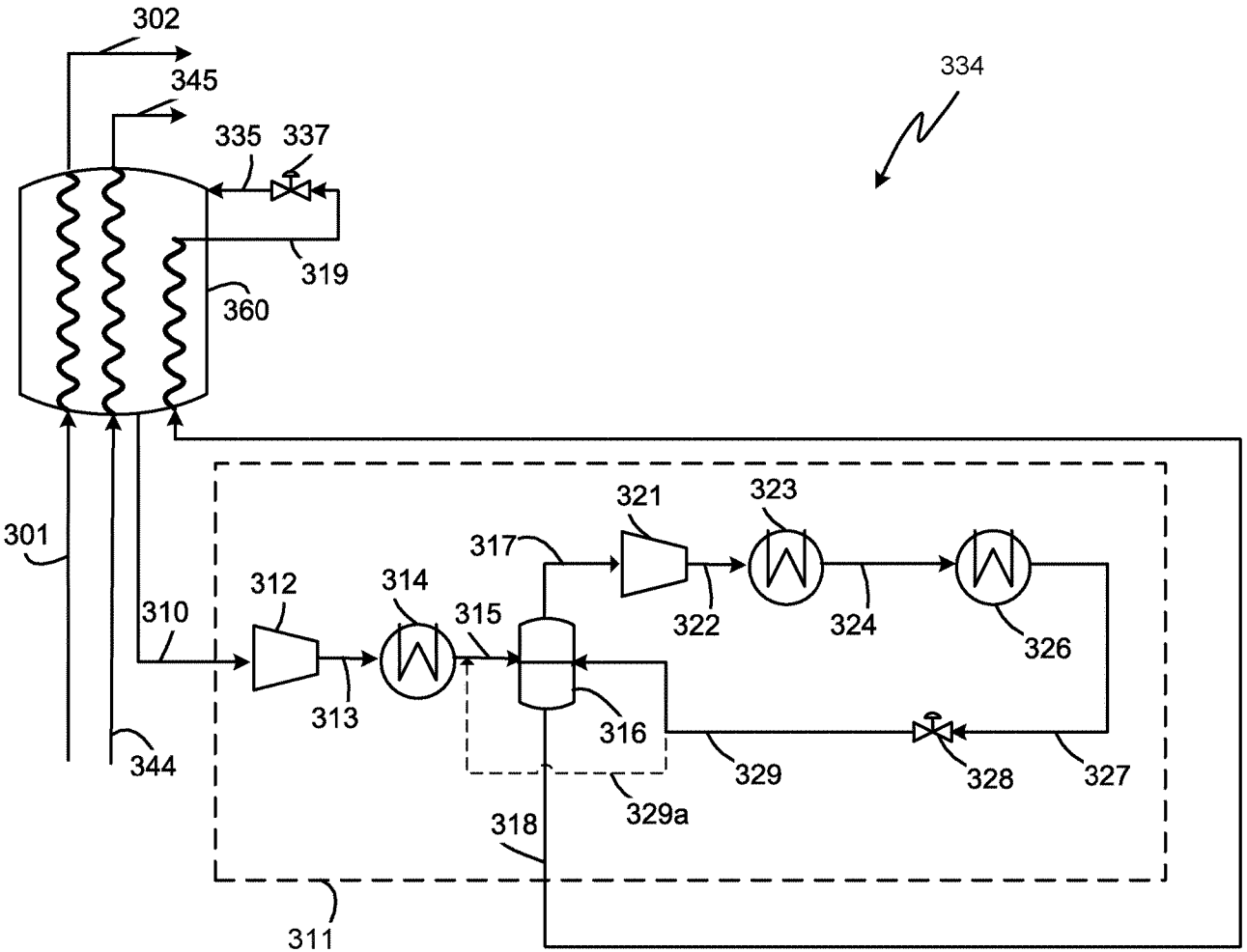
FIG. 3 is a schematic flow diagram of a precooling system of a DMR system in accordance with a first exemplary embodiment of the invention.

FIG. 3 shows a first embodiment of the invention. Any liquid present in warm low pressure WMR stream 310 is removed by passing through a phase separator (not shown) and the vapor stream from the phase separator is compressed in low pressure WMR compressor 312 to produce medium pressure WMR stream 313 that is cooled in low pressure WMR aftercooler 314 to produce cooled medium pressure WMR stream 315. The low pressure WMR aftercooler 314 may further comprise multiple heat exchangers such as a desuperheater and a condenser. The cooled medium pressure WMR stream 315 may be two-phase and sent to WMR phase separator 316 to produce a WMRV stream 317 and WMRL stream 318. The WMRL stream 318 is further cooled in a tube circuit of precooling heat exchanger 360 to produce a further cooled WMRL stream 319 that is letdown in pressure across first WMR expansion device 337 to produce expanded WMR stream 335 that is then returned to the precooling exchanger 360 as shell-side refrigerant. The pre-treated feed stream 301 is precooled in the precooling heat exchanger 360 to produce a precooled natural gas stream 302.

The WMRV stream 317 is compressed in high pressure WMR compressor 321 to produce high pressure WMRV stream 322 that is cooled in high pressure WMR desuperheater 323 to produce cooled high pressure MRV stream 324 that is further cooled and condensed in high pressure WMR condenser 326 to produce condensed high pressure WMR stream 327, that is at least partially and preferably totally condensed. Since the warm low pressure WMR stream 310 is used to precool the natural gas stream, it has a low concentration of light components such as nitrogen and methane, and predominantly contains ethane and heavier components. The warm low pressure WMR stream 310 may comprise less than 10% of components lighter than ethane, preferably less than 5% of components lighter than ethane, and more preferably less than 2% of components lighter than ethane. The light components accumulate in the WMRV stream 317, which may comprise less than 20% of components lighter than ethane, preferably less than 15% of components lighter than ethane, and more preferably less than 10% of components lighter than ethane. Therefore, it is possible to fully condense the WMRV stream 317 to produce a totally condensed high pressure WMR stream 327 without needing to compress to very high pressure. The high pressure WMRV stream 322 may be at a pressure between 450 psia (31 bara) and 700 psia (48 bara), and preferably between 500 psia (34 bara) and 650 psia (45 bara). If precooling heat exchanger 360 was a liquefaction heat exchanger used to fully liquefy the natural gas, the warm low pressure WMR stream 310 would have a higher concentration of nitrogen and methane and therefore the pressure of the high pressure WMRV stream 322 would have to be higher in order for the condensed high pressure WMR stream 327 to be fully condensed. Since this may not be possible to achieve, the condensed high pressure WMR stream 327 would not be fully condensed and would contain significant vapor concentration that may need to be liquefied separately.

The condensed high pressure WMR stream 327 is let down in pressure in second WMR expansion device 328 to produce an expanded high pressure WMR stream 329 at about the same pressure as the cooled medium pressure WMR stream 315 which may be at a pressure between 200 psia (14 bara) and 400 psia (28 bara), and preferably between 300 psia (21 bara) and 350 psia (24 bara). The expanded high pressure WMR stream 329 may be at a temperature between −10 degrees Celsius and 20 degrees Celsius and preferably between −5 degrees Celsius and 5 degrees Celsius. The expanded high pressure WMR stream 329 may have a vapor fraction of 0.1 to 0.6 and preferably between 0.2 and 0.4. The conditions of the said streams will vary based on ambient temperature and operating conditions. The expanded high pressure WMR stream 329 is returned to the WMR phase separator 316.

Alternatively, the expanded high pressure WMR stream 329 may be returned to a location upstream of the WMR phase separator 316 (shown by the dashed line 329*a* in FIG. 3), for instance, by mixing with the cooled medium pressure WMR stream 315. The first WMR expansion device 337 and the second WMR expansion device 328 may be a hydraulic turbine, a Joule-Thomson (J-T) valve, or any other suitable expansion device known in the art.

Figure 2:
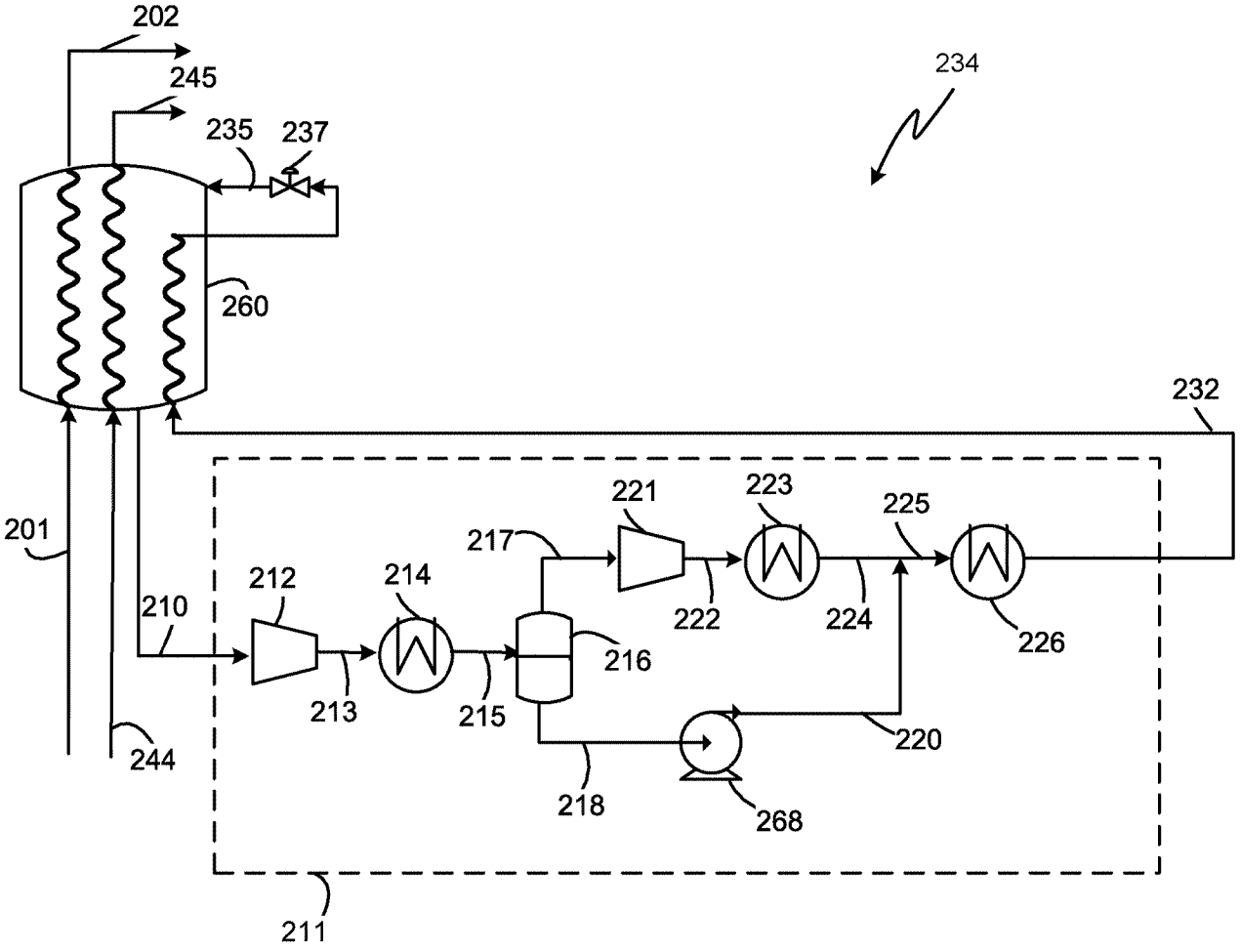
FIG. 2 (PRIOR ART)
FIG. 2 is a schematic flow diagram of a precooling system of a DMR system in accordance with the prior art.

A benefit of the embodiment shown in FIG. 3 over prior art is that the high pressure WMR condenser 326 needs to be designed only for vapor phase inlet. This helps eliminate any design issues and mitigate potential vapor-liquid distribution issues in the condenser. Additionally, the configuration shown in FIG. 3 eliminates the WMR pump 268 shown in prior art FIG. 2 and thereby reduces capital cost, equipment count, and footprint of the LNG facility.

An alternative to FIG. 3 involves the use of an ejector/eductor wherein the cooled medium pressure WMR stream 315 and the condensed high pressure WMR stream 327 are sent to an eductor to produce two-phase stream that is sent to WMR phase separator 316.

Figure 4:
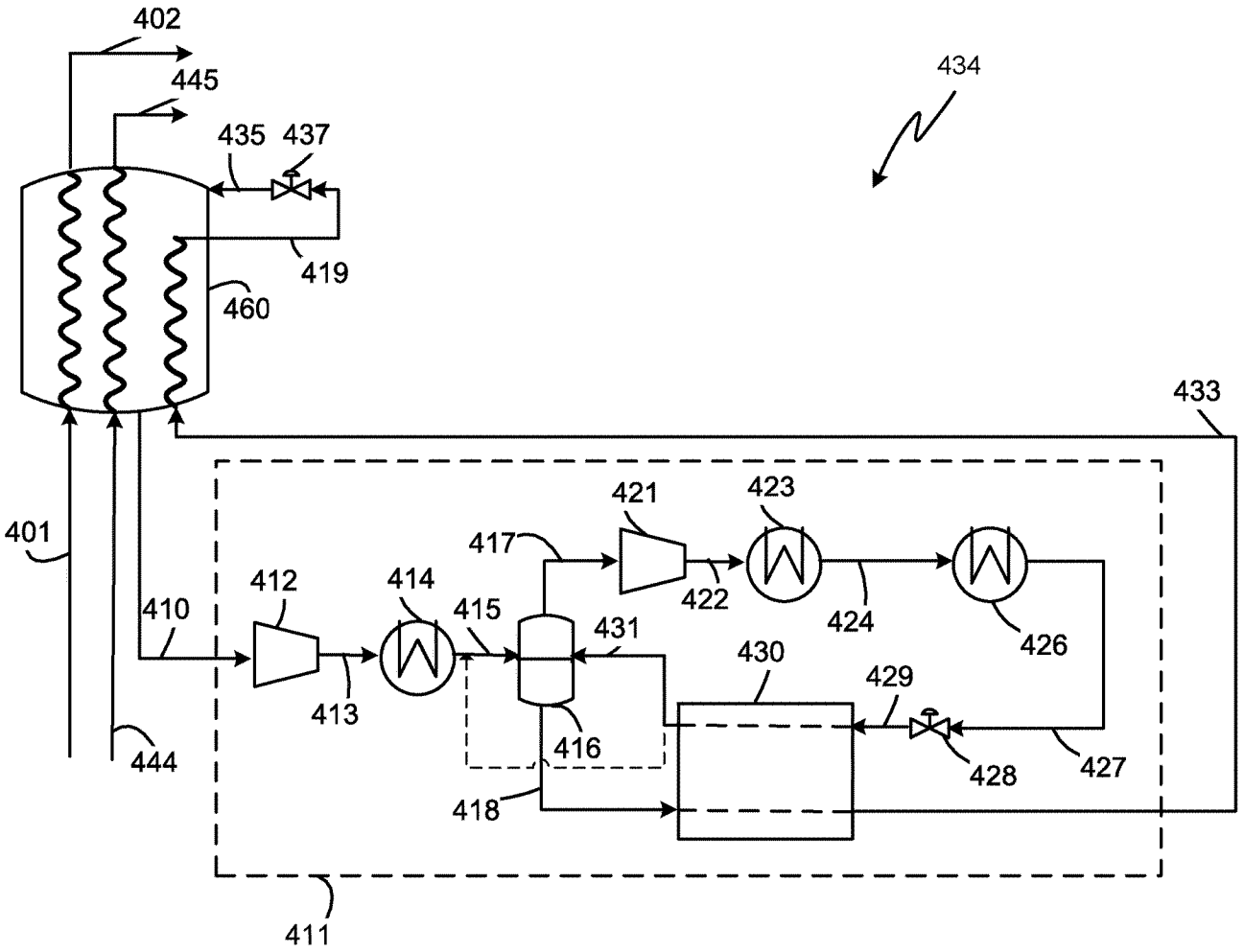
FIG. 4 is a schematic flow diagram of a precooling system of a DMR system in accordance with a second exemplary embodiment of the invention.

FIG. 4 shows a preferred embodiment of the invention. Referring to FIG. 4, any liquid present in warm low pressure WMR stream 410 is removed by passing through a phase separator (not shown) and the vapor stream from the phase separator is compressed in low pressure WMR compressor 412 to produce medium pressure WMR stream 413 that is cooled in low pressure WMR aftercooler 414 to produce cooled medium pressure WMR stream 415. The low pressure WMR aftercooler 414 may further comprise multiple heat exchangers such as a desuperheater and a condenser. The cooled medium pressure WMR stream 415 may be two-phase and sent to WMR phase separator 416 to produce a WMRV stream 417 and WMRL stream 418.

The WMRV stream 417 is compressed in high pressure WMR compressor 421 to produce high pressure WMRV stream 422 that is cooled in high pressure WMR desuperheater 423 to produce cooled high pressure MRV stream 424 that is further cooled and condensed in high pressure WMR condenser 426 to produce condensed high pressure WMR stream 427. The condensed high pressure WMR stream 427 is letdown in pressure in second WMR expansion device 428 to produce an expanded high pressure WMR stream 429. The expanded high pressure WMR stream 429 is warmed in WMR heat exchanger 430 to produce warm expanded high pressure WMR stream 431 that is returned to the WMR phase separator 416. The second WMR expansion device 428 is adjusted such that the pressure of the warm expanded high pressure WMR stream 431 is about the same as the pressure of the cooled medium pressure WMR stream 415.

The WMRL stream 418 is cooled in WMR heat exchanger 430 against the expanded high pressure WMR stream 429 to produce a cooled WMRL stream 433. The warm expanded high pressure WMR stream 431 may be at a temperature of −20 degrees Celsius and 15 degrees Celsius and preferably between −10 degrees Celsius and 0 degrees Celsius. The temperature of the said stream will vary based on ambient temperature and operating conditions.

The cooled WMRL stream 433 is further cooled in a tube circuit of the precooling heat exchanger 460 to produce a further cooled WMRL stream 319 that is letdown in pressure across a first WMR expansion device 437 to produce an expanded WMR stream 435 that is then returned to the precooling exchanger 460 as shell-side refrigerant.

WMR heat exchanger 430 may be a plate and fin, brazed aluminum, coil wound, or any other suitable type of heat exchanger known in the art. WMR heat exchanger 430 may also comprise multiple heat exchangers in series or parallel.

The embodiment shown in FIG. 4 retains all the benefits of FIG. 3 over the prior art. Additionally, this embodiment improves the process efficiency of the process shown in FIG. 3 by about 2% thereby reducing the required power for the same amount of LNG produced. The increase in efficiency observed is primarily due to colder temperature of the liquid stream being sent into the precooling heat exchanger.

An alternative embodiment is a variation of FIG. 4 wherein the heat exchanger 430 provides indirect heat exchange between the expanded high pressure WMR stream 429 and the WMRV stream 417 (instead of the WMRL stream 418). This embodiment results in colder conditions at the suction of high pressure WMR compressor 421.

A further embodiment is a variation of FIG. 4 wherein the heat exchanger 430 provides indirect heat exchange between the expanded high pressure WMR stream 429 and the cooled medium pressure WMR stream 415. This embodiment results in cooling both the inlet of high pressure WMR compressor 421 and cooled WMRL stream 433.

The expanded high pressure WMR stream 429 may be two-phase. However, it is expected that the performance of the WMR heat exchanger 430 is not significantly affected due to the low amount of vapor typically present in the expanded high pressure WMR stream 429. In scenarios wherein higher amounts of vapor are present in the expanded high pressure WMR stream 429, FIG. 5 provides an alternative embodiment.

Figure 5:
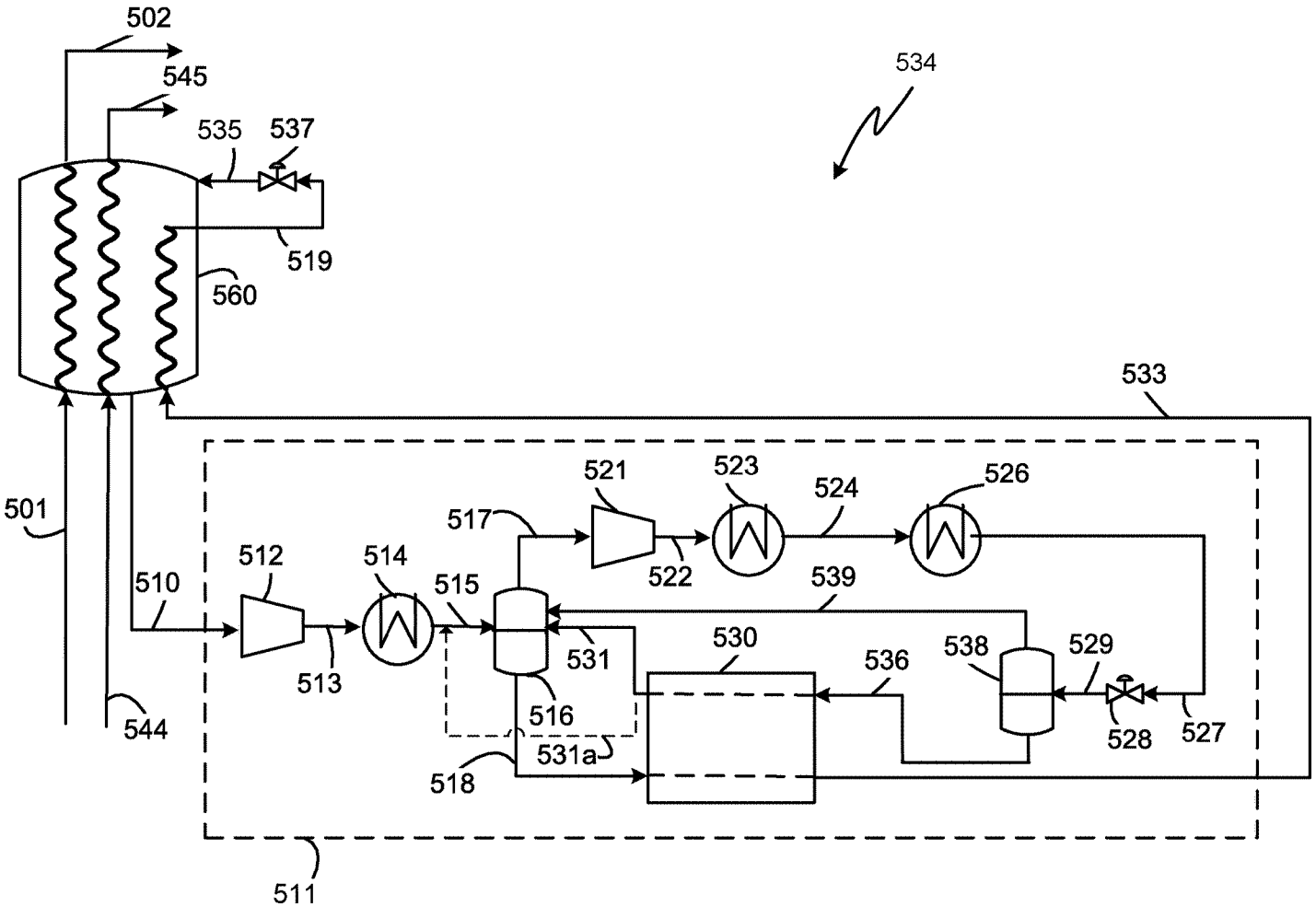
FIG. 5 is a schematic flow diagram of a precooling system of a DMR system in accordance with a third exemplary embodiment of the invention.

Referring to FIG. 5, expanded high pressure WMR stream 529 is sent to a second WMR phase separator 538 to produce a second WMRV stream 539 and a second WMRL stream 536. The second WMRV stream 539 is returned to a WMR phase separator 516. The second WMR expansion device 528 is adjusted such that the second MRV stream 539 is about the same pressure as the cooled medium pressure WMR stream 515.

The second WMRL stream 536 is warmed in WMR heat exchanger 530 to produce a warm expanded high pressure WMR stream 531 that is returned to the WMR phase separator 516. Alternatively, the warm expanded high pressure WMR stream 531 could be mixed with the cooled medium pressure WMR stream 515 upstream from the WMR phase separator 516 (shown by dashed line 531*a* in FIG. 5). The WMRL stream 518 from WMR phase separator 516 is cooled in the WMR heat exchanger 530 against the second WMRL stream 536 to produce a cooled WMRL stream 533. The cooled WMRL stream 533 is further cooled in a tube circuit of the precooling heat exchanger 560 to produce a further cooled WMRL stream 319 that is letdown in pressure across a first WMR expansion device 537 to produce an expanded WMR stream 535 that is then returned to the precooling exchanger 560 as shell-side refrigerant.

The embodiment disclosed in FIG. 5 possesses all the benefits of FIG. 4. It includes an additional piece of equipment and is beneficial in scenarios with high vapor flow from the second WMR expansion device 528.

In an alternative embodiment, the second WMRV stream 539 is warmed by passing through a separate passage of the WMR heat exchanger 530 prior to being returned to the WMR phase separator 516.

Figure 6:
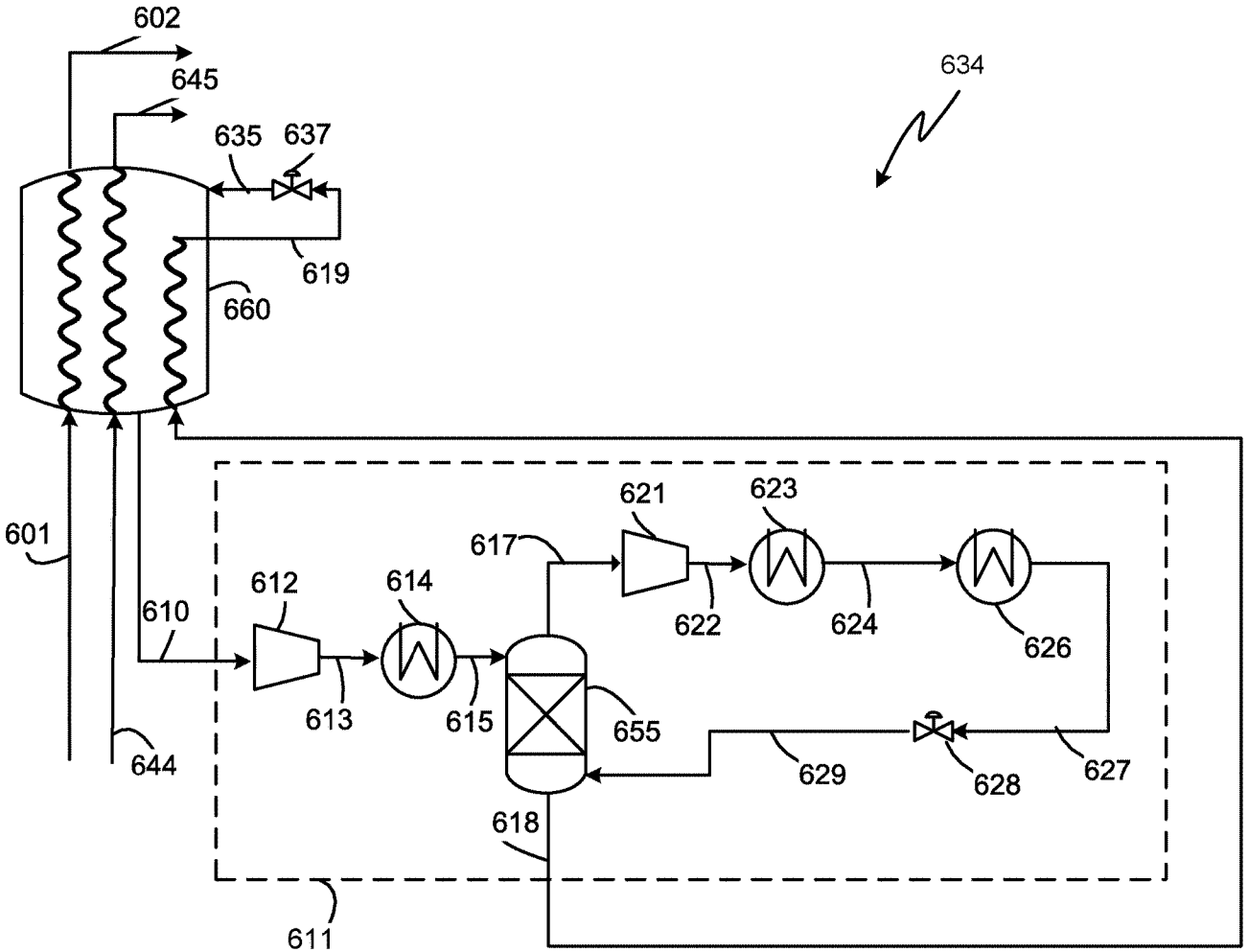
FIG. 6 is a schematic flow diagram of a precooling system of a DMR system in accordance with a fourth exemplary embodiment of the invention.

FIG. 6 shows a further embodiment of the invention and is a variation of FIG. 3. Warm low pressure WMR stream 610 is compressed in a low pressure WMR compressor 612 to produce a medium pressure WMR stream 613 that is cooled in a low pressure WMR aftercooler 614 to produce a cooled medium pressure WMR stream 615. The low pressure WMR aftercooler 614 may further comprise multiple heat exchangers such as a desuperheater and a condenser. The cooled medium pressure WMR stream 615 is sent to a top stage of a mixing column 655 to produce a WMRV stream 617 from a top stage of the mixing column 655 and a WMRL stream 618 from a bottom stage of the mixing column 655. The WMRL stream 618 is further cooled in a tube circuit of precooling heat exchanger 660 to produce a further cooled WMRL stream 319 that is letdown in pressure across first WMR expansion device 637 to produce expanded WMR stream 635 that is then returned to the precooling exchanger 660 as shell-side refrigerant.

The WMRV stream 617 is compressed in a high pressure WMR compressor 621 to produce a high pressure WMRV stream 622 that is cooled in a high pressure WMR desuperheater 623 to produce a cooled high pressure MRV stream 624 that is further cooled and condensed in high pressure WMR condenser 626 to produce condensed high pressure WMR stream 627. The condensed high pressure WMR stream 627 is letdown in pressure in second WMR expansion device 628 to produce an expanded high pressure WMR stream 629. The expanded high pressure WMR stream 629 is returned to the bottom stage of the mixing column 655. This embodiment possesses all the benefits of FIG. 3 and results in higher process efficiency as compared to FIG. 3 due to cooling the liquid stream being sent to the precooling heat exchanger.

Mixing columns, such as mixing column 655, operate on the same thermodynamic principles as a distillation column (also referred to in the art as a separation or fractionation column). However, the mixing column 655 performs a task opposite to a distillation column. It reversibly mixes fluids in a plurality of equilibrium stages, instead of separating the components of a fluid. In contrast to a distillation column, the top of the mixing column is warmer than the bottom. The mixing column 655 may contain packing and/or any number of trays. A top stage refers to the top tray or top section of the mixing column 655. A bottom stage refers to the bottom tray or bottom section of the mixing column 655.

An alternative embodiment involves replacing the mixing column with a distillation column. In this embodiment, the expanded high pressure WMR stream 629 is inserted at a top stage of the distillation column to provide reflux, while the cooled medium pressure WMR stream 615 is inserted at a lower stage of the column. Additional reboiler duty or condensing duty may be provided.

Figure 7:
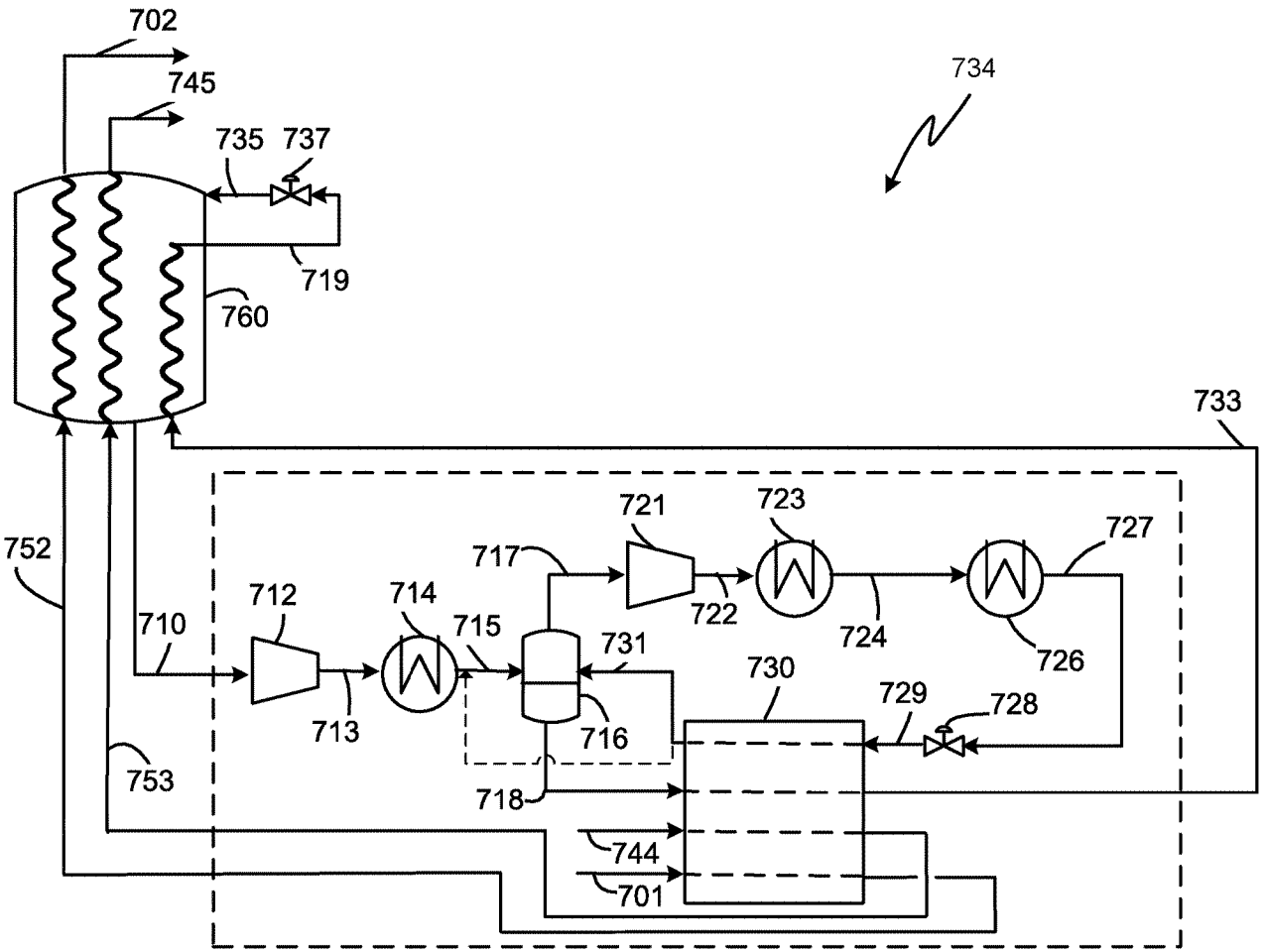
FIG. 7 is a schematic flow diagram of a precooling system of a DMR system in accordance with a fifth exemplary embodiment of the invention.

The embodiment shown in FIG. 7 is a variation of that shown in FIG. 4. In this embodiment, the pre-treated feed stream 701 and the compressed cooled CMR stream 745 are also cooled by indirect heat exchange with the expanded high pressure WMR stream 729 in WMR heat exchanger 730 to produce cooled pre-treated feed stream 752 and compressed twice-cooled CMR stream 753 respectively.

The cooled pre-treated feed stream 752 and the compressed twice-cooled CMR stream 753 are further cooled in separate tube circuits of the precooling heat exchanger 760.

This embodiment further improves the efficiency of the process by reducing the temperature of the feed streams in the precooling heat exchanger 760 as well as ensuring that the feed streams to the precooling heat exchanger 760 are at similar temperatures. In an alternate embodiment, only one of the pre-treated feed stream 701 and the compressed cooled CMR stream 745 are cooled in the WMR heat exchanger 730.

For all the embodiments described herein, the composition of the WMR stream may be adjusted with varying feed composition, ambient temperature, and other conditions. Typically, the WMR stream contains over 40 mole percent and preferably over 50 mole percent of components lighter than butane.

The embodiments of the invention described herein are applicable to any compressor design including any number of compressors, compressor casings, compression stages, presence of inter or after-cooling, etc. Further, the embodiments described herein are applicable to any heat exchanger type such as plate and fin heat exchangers, coil wound heat exchangers, shell and tube heat exchangers, brazed aluminum heat exchangers, kettle, kettle-in-core, and other suitable heat exchanger designs. Although the embodiments described herein refer to mixed refrigerants comprising hydrocarbons and nitrogen, they are also applicable to any other refrigerant mixture such as fluorocarbons. The methods and systems associated with this invention can be implemented as part of new plant design or as a retrofit for existing LNG plants.

Example 1

The following is an example of the operation of an exemplary embodiment of the invention. The example process and data are based on simulations of a DMR process in an LNG plant that produces about 5.5 million metric tons per annum of LNG and specifically refers to the embodiment shown in FIG. 4. In order to simplify the description of this example, elements and reference numerals described with respect to the embodiment shown in FIG. 4 will be used.

Warm low pressure WMR stream 410 at 51 degrees Fahrenheit (11 degrees Celsius), 55 psia (3.8 bara) and 42,803 lbmol/hr (19,415 kmol/hr) is compressed in low pressure WMR compressor 412 to produce medium pressure WMR stream 413 at 207 degrees Fahrenheit (97.5 degrees Celsius) and 331 psia (22.8 bara) that is cooled in low pressure WMR aftercooler 414 to produce cooled medium pressure WMR stream 415 at 77 degrees Fahrenheit (25 degrees Celsius) and 316 psia (21.8 bara). The cooled medium pressure WMR stream 415 is sent to WMR phase separator 416 to produce a WMRV stream 417 and WMRL stream 418.

The WMRV stream 417 of 15,811 lbmol/hr (7172 kmol/hr) is compressed in high pressure WMR compressor 421 to produce high pressure WMRV stream 422 at 146 degrees Fahrenheit (63 degrees Celsius) and 598 psia (41 bara) that is cooled in high pressure WMR desuperheater 423 to produce cooled high pressure MRV stream 424 that is further cooled and condensed in high pressure WMR condenser 426 to produce condensed high pressure WMR stream 427 at 77 degrees Fahrenheit (25 degrees Celsius), 583 psia (40.2 bara), and vapor fraction of 0. The condensed high pressure WMR stream 427 is letdown in pressure in second WMR expansion device 428 to produce an expanded high pressure WMR stream 429 at 34 degrees Fahrenheit (1.4 degrees Celsius) and 324 psia (22.2 bara). The expanded high pressure WMR stream 429 is warmed in WMR heat exchanger 430 to produce warm expanded high pressure WMR stream 431 at 53 degrees Fahrenheit (11.8 degrees Fahrenheit) and 316 psia (21.8 bara) that is returned to the WMR phase separator 316. In this example, the warm low pressure WMR stream 410 contains 1% of components lighter than ethane and the vapor fraction of the expanded high pressure WMR stream 429 is 0.3.

The WMRL stream 418 of 42,800 lbmol/hr (19,415 kmol/hr) is cooled in WMR heat exchanger 430 against the expanded high pressure WMR stream 429 to produce a cooled WMRL stream 433 at 38 degrees Fahrenheit (3.11 degrees Celsius) and 308 psia (21.2 bara).

The pre-treated feed stream 401 enters the precooling heat exchanger 460 at 68 degrees Fahrenheit (20 degrees Celsius), 1100 psia (76 bara) to produce precooled natural gas stream 402 at −41 degrees Fahrenheit (−40.5 degrees Celsius) and vapor fraction of 0.74. The compressed cooled CMR stream 444 enters the precooling heat exchanger 460 at 77 degrees Fahrenheit (25 degrees Celsius), 890 psia (61 bara) to produce the precooled CMR stream 445 at −40 degrees Fahrenheit (−40 degrees Celsius) and vapor fraction of 0.3.

In this example, the efficiency of the process was found to be 2-3% higher than that corresponding to FIG. 3. Therefore, this example demonstrates that the invention provides an efficient and low cost method and system to eliminate two-phase entry in the WMR condenser heat exchanger and also eliminate the WMR liquid pump.

The invention claimed is:

1. A method of cooling a hydrocarbon feed stream by indirect heat exchange with a first refrigerant stream in a cooling heat exchanger wherein the method comprises:

a) compressing a warm low pressure first refrigerant stream in one or more compression stages to produce a compressed first refrigerant stream;

b) cooling the compressed first refrigerant stream in one or more cooling units to produce a compressed cooled first refrigerant stream;

c) introducing the compressed cooled first refrigerant stream into a first vapor-liquid separation device to produce a first vapor refrigerant stream and a first liquid refrigerant stream;

d) introducing the first liquid refrigerant stream into the cooling heat exchanger;

e) cooling the first liquid refrigerant stream in the cooling heat exchanger to produce a cooled liquid refrigerant stream;

f) expanding the cooled liquid refrigerant stream to produce a cold refrigerant stream, introducing the cold refrigerant stream into the cooling heat exchanger to provide refrigeration duty required to cool the hydrocarbon feed stream, the first liquid refrigerant stream, and a second refrigerant stream;

g) compressing the first vapor refrigerant stream in one or more compression stages to produce a compressed vapor refrigerant stream;

h) cooling and condensing the compressed vapor refrigerant stream to produce a condensed refrigerant stream;

i) expanding the condensed refrigerant stream to produce an expanded refrigerant stream at a first temperature;

j) introducing the expanded refrigerant stream at the first temperature directly into the first vapor-liquid separation device;

k) introducing the second refrigerant stream into the cooling heat exchanger;

l) introducing the hydrocarbon feed stream in the cooling heat exchanger; and m) cooling the hydrocarbon feed stream in the cooling heat exchanger to produce a cooled hydrocarbon stream; and further cooling and liquefying the cooled hydrocarbon stream in a main heat exchanger to produce a liquefied hydrocarbon stream.

2. The method of claim 1, wherein step (i) comprises introducing the expanded refrigerant stream into the first vapor-liquid separation device by mixing the expanded refrigerant stream with the compressed cooled first refrigerant stream upstream of the first vapor-liquid separation device.

3. The method of claim 1, wherein the only first refrigerant stream to be cooled in the cooling heat exchanger is the first liquid refrigerant stream.

4. The method of claim 1, wherein:

step (e) further comprises cooling the first liquid refrigerant stream in the cooling heat exchanger by passing the first refrigerant stream through a first tube circuit of the cooling heat exchanger, wherein the cooling heat exchanger is a coil wound heat exchanger;

step (m) further comprises cooling the hydrocarbon feed stream in the cooling heat exchanger by passing the hydrocarbon feed stream through a second tube circuit of the cooling heat exchanger; and step (f) further comprises introducing the cold refrigerant stream into a shell-side of the cooling heat exchanger.

5. The method of claim 1, further comprising:

n) cooling the second refrigerant stream in the cooling heat exchanger to produce a cooled second refrigerant stream;

o) further cooling the cooled second refrigerant stream in the main heat exchanger to produce a further cooled second refrigerant stream;

p) expanding the further cooled second refrigerant stream to produce an expanded second refrigerant stream;

q) returning the expanded second refrigerant stream to the main heat exchanger;

and r) further cooling and condensing the cooled hydrocarbon stream by indirect heat exchange with the expanded second refrigerant stream in the main heat exchanger to produce the liquefied hydrocarbon stream.

6. The method of claim 1, wherein step (c) comprises introducing the compressed cooled first refrigerant stream into a first vapor-liquid separation device comprising a mixing column to produce a first vapor refrigerant stream and a first liquid refrigerant stream.

7. The method of claim 6, wherein the compressed cooled first refrigerant stream is introduced into the mixing column at or above a top stage of the mixing column and the expanded first refrigerant stream is introduced to the mixing column at or below a bottom stage of the mixing column.

8. The method of claim 1, wherein the hydrocarbon feed stream is natural gas.

9. An apparatus for cooling a hydrocarbon feed stream comprising:

a cooling heat exchanger including a first hydrocarbon feed circuit, a first refrigerant circuit, a second refrigerant circuit, a first refrigerant circuit inlet located at an upstream end of the first refrigerant circuit, a first pressure letdown device located at a downstream end of the first refrigerant circuit, and an expanded first refrigerant conduit downstream from and in fluid flow communication with the pressure letdown device, the cooling heat exchanger being operationally configured to cool, by indirect heat exchange against a cold refrigerant stream, the hydrocarbon feed stream as it flows through the first hydrocarbon feed circuit, thereby producing a pre-cooled hydrocarbon feed stream, a first refrigerant flowing through the first refrigerant circuit, and a second refrigerant flowing through the second refrigerant circuit; and a compression system comprising:

a warm low pressure first refrigerant conduit in fluid flow communication with a lower end of the cooling heat exchanger and a first compressor;

a first aftercooler in fluid flow communication with and downstream from the first compressor;

a first vapor-liquid separation device having a first inlet in fluid flow communication with and downstream from the first aftercooler, a first vapor outlet located in an upper half of the first vapor-liquid separation device, a first liquid outlet located in a lower half of the first vapor-liquid separation device, the first liquid outlet being upstream from and in fluid flow communication with the first refrigerant circuit inlet;

a second compressor downstream from and in fluid flow communication with the first vapor outlet;

a condenser downstream from and in fluid flow communication with the second compressor; and a second pressure letdown device downstream from and in fluid flow communication with the condenser, the second pressure letdown device being upstream from and in direct fluid flow communication with the first vapor-liquid separation device, so that all fluid that flows through the second pressure letdown device is expanded and produces an expanded fluid at a first temperature, and the expanded fluid is returned directly to the first vapor-liquid separation device at the first temperature.

10. The apparatus of claim 9, further comprising:

a main heat exchanger having a second hydrocarbon circuit that is downstream from and in fluid flow communication with the first hydrocarbon circuit of the cooling heat exchanger, the main heat exchanger being operationally configured to at least partially liquefy the pre-cooled hydrocarbon feed stream by indirect heat exchange against the second refrigerant.

11. The apparatus of claim 9, wherein the first vapor-liquid separation device is a mixing column.

12. The apparatus of claim 11, wherein the first inlet of the first liquid-vapor separation device is located at a top stage of the mixing column and a second inlet of the first liquid-vapor separation device is located at a bottom stage of the mixing column.

* * * * *